US007913659B2

(12) United States Patent
Maupin

(10) Patent No.: US 7,913,659 B2
(45) Date of Patent: Mar. 29, 2011

(54) CARBURETOR START SYSTEM

(75) Inventor: Cory Matthew Maupin, Thompsons Station, TN (US)

(73) Assignee: Zama Japan Kabushiki Kaisha (JP)

( * ) Notice: Subject to any disclaimer, the term of this patent is extended or adjusted under 35 U.S.C. 154(b) by 418 days.

(21) Appl. No.: 12/187,718

(22) Filed: Aug. 7, 2008

(65) Prior Publication Data

US 2009/0314240 A1 Dec. 24, 2009

Related U.S. Application Data

(60) Provisional application No. 61/074,486, filed on Jun. 20, 2008.

(51) Int. Cl.
*F02M 1/16* (2006.01)

(52) U.S. Cl. ..... 123/179.11; 261/36.2

(58) Field of Classification Search ..... 123/179.9, 123/179.11, 400

See application file for complete search history.

(56) References Cited

U.S. PATENT DOCUMENTS

| | | | | |
|---|---|---|---|---|
| 5,706,774 | A | 1/1998 | Shaw | |
| 5,942,160 | A | 8/1999 | Araki | |
| 6,142,455 | A | 11/2000 | Araki | |
| 6,231,033 | B1 | 5/2001 | Araki | |
| 6,799,545 | B2 | 10/2004 | Shaw | |
| 7,185,623 | B2 | 3/2007 | Shaw | |
| 7,467,785 | B2 * | 12/2008 | Braun | 261/34.2 |
| 7,690,342 | B2 * | 4/2010 | Gliniecki et al. | 123/179.11 |

* cited by examiner

*Primary Examiner* — Hai H Huynh

(74) *Attorney, Agent, or Firm* — Orrick, Herrington & Sutcliffe LLP

(57) ABSTRACT

Carburetor start system comprising a primer pump bulb coupled to a valve-opening mechanism, the primer pump bulb and valve-opening mechanism being operably coupled to a throttle valve and/or a choke valve. Pushing the primer pump bulb causes the throttle valve and/or choke valve to be rotated and releasably fixed in a starting position.

20 Claims, 10 Drawing Sheets

CARBURETOR START SYSTEM

CROSS-REFERENCE TO RELATED APPLICATION

This application claims the benefit of co-pending provisional application Ser. No. 61/074,486 filed Jun. 20, 2008, which application is fully incorporated herein by reference.

FIELD

The present invention relates to carburetors and general purpose engines and, more particularly, to a carburetor start system which facilitates reliable starting and operation of such engines.

BACKGROUND

A variety of carburetors are used to supply fuel to general purpose two-cycle engines typically used as a source of motive power in lawn and garden machinery and the like. Such carburetors may include a butterfly throttle valve or a cylindrical throttle valve is installed crosswise in the air intake passage of the carburetor main body. The throttle valve controls the air flow rate by varying the degree of opening of the air intake passage. In a state where the throttle is released, the throttle valve is placed in a position which supplies the air and fuel necessary for idle revolution of the engine. From the idle position, the throttle valve is moved in accordance with the operation of the throttle to increase the amounts of air and fuel.

The most common starting system for a lawn and garden engine requires the user to complete multiple steps in order to start the engine. For example, the carburetor is first purged of old fuel and air by pushing and releasing the primer pump bulb. Second, the user must push a lever to close the choke. The third step in the process is to pull a starter rope to crank the engine until the engine starts and dies. Often the only indication that the engine tried to start is an audible pop which is difficult to identify. Step four is to put the choke lever in the half choke position and pull the starter rope again until the engine starts and runs. The final step is to put the choke lever in the run position while the engine is running and proceed to use the unit. The procedure for starting the engine will change depending on conditions such as temperature and when the unit was last used. This conventional starting process creates opportunities for mistakes and confusion. The most frequent reason for lawn and garden units being returned to the retailer is that unit will not start or is difficult to start.

Thus, an improved system and method that facilitates reliable starting and operation of such engines is desirable.

SUMMARY

The various embodiments and examples provided herein are generally directed to carburetors comprising a start system that facilitates reliable starting and operation of general purpose engines. In preferred embodiments described herein, the conventional multi-step starting process is advantageously reduced by combining into a single step the steps of purging of the carburetor of old fuel and activating of the starting system in which a throttle and/or a choke valve are opened to a starting position. The present system provides the user with a starting procedure that is simplistic and less prone to operator error. The system functions the same regardless of conditions.

In operation, the start system fills the carburetor with fuel and places a throttle and/or choke valve in a predetermined start position in a single step as a primer pump bulb is pushed. More particularly, the start system translates the axial force used to push the primer pump bulb into rotational movement of the throttle and/or choke valve.

Other objects and features of the present invention will become apparent from consideration of the following description taken in conjunction with the accompanying drawings.

BRIEF DESCRIPTION OF THE DRAWINGS

The details of the invention, both as to its structure and operation, may be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes may be illustrated schematically rather than literally or precisely.

FIGS. 1, 3 and 5 are plan views of the carburetor in a "starting" orientation, and FIGS. 2, 4 and 6 are plan views of the carburetor in a "running" orientation.

FIG. 8A depicts the carburetor in a "starting" orientation, and FIG. 8B depicts the carburetor in a "running" orientation.

FIGS. 12, 14 and 16 are plan views of the carburetor in a "running" orientation, and FIG. 13, 15 and 17 are plan views of the carburetor in a "starting" orientation.

FIG. 18 is a plan view of the carburetor in a "starting" orientation, and FIG. 19 is a plan view of the carburetor in a "running" orientation.

FIG. 22 is a partial longitudinal sectional view, and FIG. 23 is a partial plan view.

DETAILED DESCRIPTION OF THE PREFERRED EMBODIMENT

Figure 1:
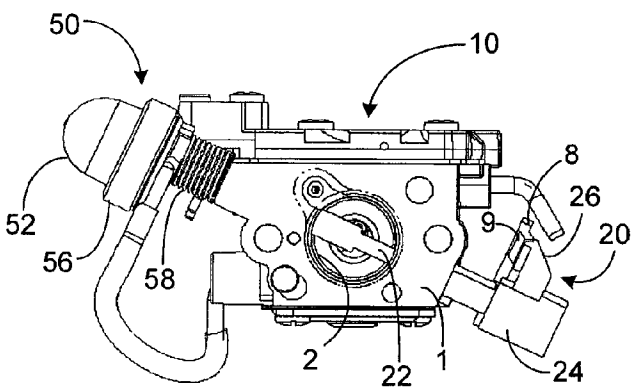
FIGS. 1 through 6 illustrate a butterfly or disc throttle valve carburetor embodiment with a start system that facilitates reliable starting.
Figure 2:
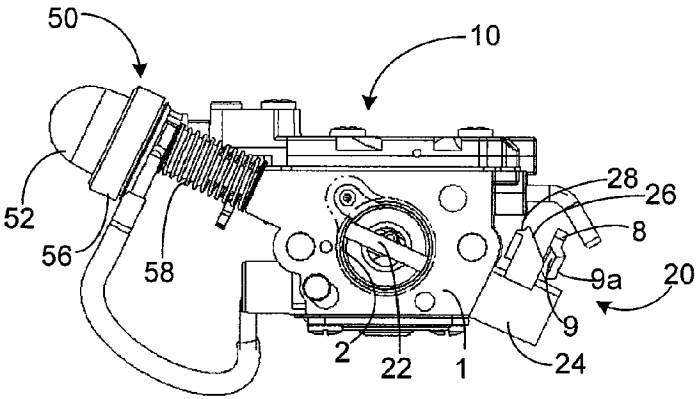
Figure 3:
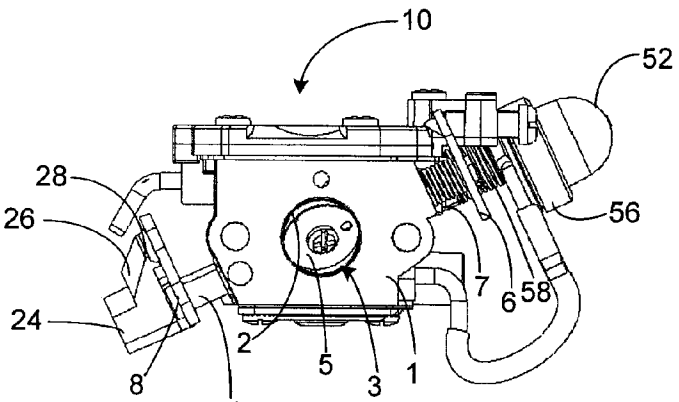
Figure 4:
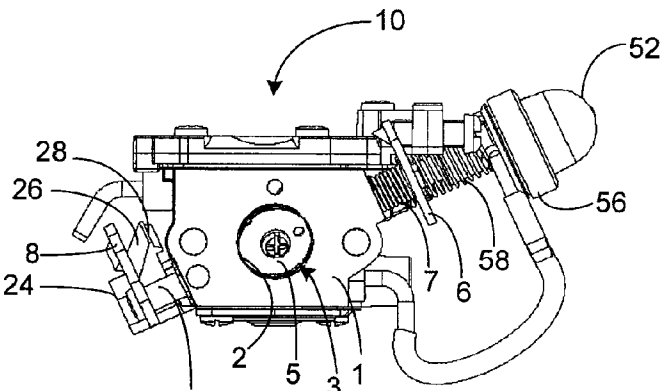
Figure 5:
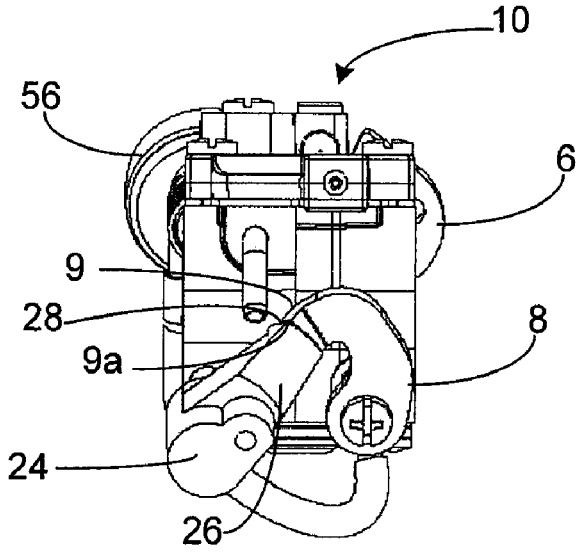
Figure 6:
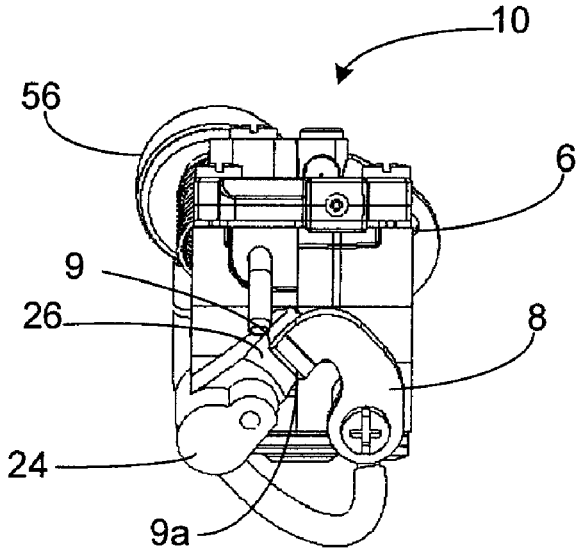

Each of the additional features and teachings disclosed below can be utilized separately or in conjunction with other features and teachings to provide carburetors with a start system that facilitates reliable starting and operation of general purpose engines. Representative examples of the present invention, which examples utilize many of these additional features and teachings both separately and in combination, will now be described in further detail with reference to the attached drawings. This detailed description is merely intended to teach a person of skill in the art further details for practicing preferred aspects of the present teachings and is not intended to limit the scope of the invention. Therefore, combinations of features and steps disclosed in the following detail description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

Embodiments of the present invention are described below with reference to the drawings and are directed to a start system that fills the carburetor with fuel and places a throttle and/or choke valve in a predetermined start position in a single step. More particularly, the start system translates the axial force used to depress a primer pump bulb into rotational movement of the throttle and/or choke valve.

Referring to FIGS. 1 through 6, an embodiment of a carburetor start system is illustrated. As depicted, a carburetor 10 includes a main body 1 with an air intake passage 2 passing longitudinally through the carburetor main body 1. A conventional butterfly throttle valve 3 is provided so that both ends of a valve shaft 4 protrude from the body 1. The throttle valve 3 comprises a round valve plate 5 attached to the valve shaft 4 rotatably retained in the body 1 and crossing the intake channel 2. Opening and closing of the throttle valve 3 is conducted by a well-known conventional method, for example, by tension rotating a throttle valve lever arm 6 secured to one end of the valve shaft 4 by an acceleration operation, or by an elastic force of a return spring 7 consisting of a helical coil spring installed at the same end of the shaft 4 and actuated by the throttle valve lever arm 6.

A carburetor start system 50 comprises a primer pump bulb 52 operably coupled to a valve-opening mechanism 20. The primer pump bulb 52, which is in fluid communication with a fuel metering chamber and the air intake passage 2, includes a base body 56 coupled to a first end of a starter shaft 22 slidably retained in the carburetor body 1. The starter shaft 22 traverses the air intake passage 2 and protrudes at both ends from opposite sides of the carburetor body 1. A start arm 24 having a cam surface 26 is coupled to the starter shaft 22 on an opposite end of the shaft 22. The cam surface 26 and a follower surface 9 on a follower arm 8, which is secured to the throttle valve shaft 4 at an end opposite the throttle valve lever 6, translate the axially movement of the starter shaft 22 into rotation movement of the throttle shaft 4.

In operation, as the primer pump bulb 52 is initially pressed to purge the carburetor 10 of old fuel, the shaft 22 and start arm 24 move axially and a follower surface 9 on the follower arm 8 coupled to the throttle shaft 4 follows the cam surface 26 on the start arm 24 causing rotation of the throttle shaft 4 and valve plate 5 to fast idle position that will make starting easier. Locking surfaces 9*a* and 28 on the follower arm 8 and the start arm 24, respectively, engage to lock the start arm 24 and follower arm 8 in place. The primer pump bulb 52 can be pushed or depressed several more times, preferably about five (5) to seven (7) times, to fill the carburetor 10 with fuel. With the start arm 24 and follower arm 8 fixedly engaged, and the carburetor 10 primed with fuel, the operator can pull a pull or crank rope or cord to start an engine to which the carburetor is coupled.

As the throttle lever arm 6 rotates in a run mode or during operation of the engine, the start arm 24 is released from engagement with the follower arm 8 and the shaft is caused to translate to its original or running position by an axial return spring 58. The axial return spring 58 is coiled about the starter shaft 22 between the base body 56 and the carburetor body 1 and biases the primer pump bulb 52, shaft 22 and start arm 24 towards a running position wherein the start arm 24 is disengaged from and does not interfere with the operation of the follower arm 8.

Figure 7:
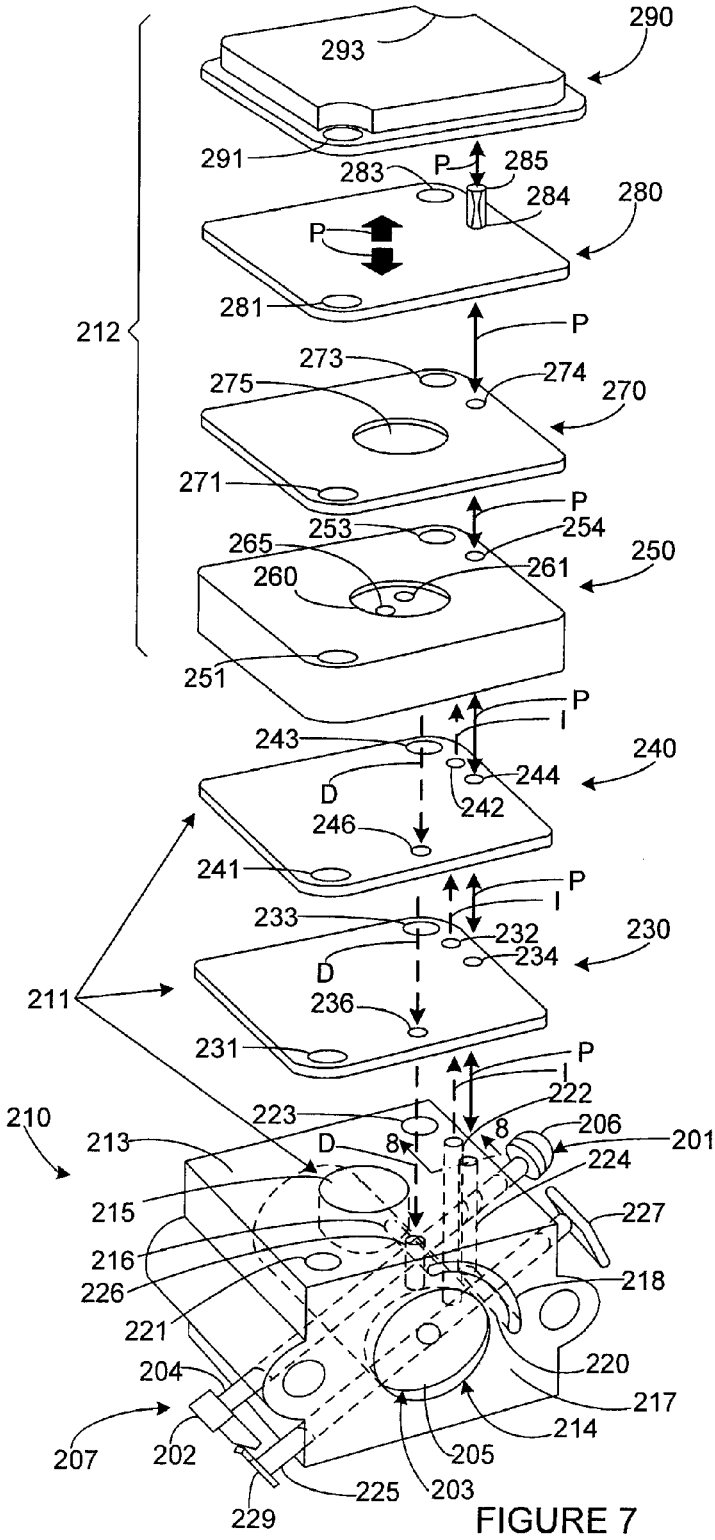
FIG. 7 is an exploded isometric view of a preferred embodiment of a carburetor start system incorporated with a start pump circuit.

Turning to FIGS. 7-11, the carburetor start system is shown incorporated with a start pump circuit. Referring to FIG. 7, a relatively standard carburetor body 210 includes a main pulse passageway 216 bored into the carburetor body 210 from its face 217. The main pulse passageway 216 opens into a pulse chamber 215 of a main fuel pump 211 bored into the carburetor body 210 from a top surface 213. A starting pulse passageway 220 is also bored into the carburetor body 210 from the face 217. A channel 218, preferably about two millimeters wide, is cut into the face 217 of the carburetor body 210. The channel 218 runs from the main pulse passageway 216 to the starting pulse passageway 220 to carry the crankcase pulse to the starting pulse passageway 220. The channel 218 is interconnected to the crank case of an engine at a point adjacent to the main pulse passageway 216. The remainder of the channel 218 is covered by a carburetor mounting gasket (not shown) which interposes the carburetor body 210 and the engine (not shown) when the carburetor is mounted on the engine.

Three passageways are bored into the carburetor body 210 from the top surface 213. The first is a pulse passageway 224 which opens into the starting pulse passageway 220. The second is a fuel intake passageway 222 which opens into the metering chamber (not shown) of the carburetor body 210. The third is a fuel discharge passageway 226 which opens into a throttle bore 214 of the air intake of the carburetor body 210.

A pair of holes 221 and 223 are tapped into the top surface 213 of the carburetor body 210 and used to mount a main fuel pump 211 and an auxiliary or start fuel pump 212. The main fuel pump 211, which operates in a manner known in the art, includes a flat fuel pump diaphragm 230 mounted on the top surface 213 of the carburetor body 210. The diaphragm 230 interposes the carburetor body 210 and a fuel pump gasket 240. The fuel pump diaphragm 230 includes a pair of holes 231 and 233 that are aligned with holes 221 and 223 in the carburetor body 210 to mount the diaphragm 230 on the carburetor body 210. In addition, the fuel pump diaphragm 230 includes a fuel intake hole 232, a pulse hole 234, and a fuel discharge hole 236. The fuel intake hole 232, the pulse hole 234, and the fuel discharge hole 236, respectively, are aligned with the fuel intake passageway 222, the pulse passageway 224, and the fuel discharge passageway 226, respectively, in the carburetor body 210 when the fuel pump diaphragm 230 is mounted on the top surface 213 of the carburetor body 210.

The fuel pump gasket 240, which mounts on the carburetor body 210 on top of the fuel pump diaphragm 230, also includes a pair of holes 241 and 243 that are aligned with holes 221 and 223 in the carburetor body 210 to mount the gasket 240. The fuel pump gasket 240 also includes a fuel intake hole 242, a pulse hole 244, and a fuel discharge hole 246, respectively, that are aligned with the fuel intake passageway 222, the pulse passageway 224, and the fuel discharge passageway 226, respectively, in the carburetor body 210 when the fuel pump gasket 240 is mounted on the carburetor body 210.

The auxiliary fuel pump 212 includes a pump body 250 mounted on top of the main fuel pump 211, a start pump gasket 270 mounted on top of the start pump body 250, a start pump diaphragm 280 mounted on top of the start pump gasket 270 and a start pump cover 290 mounted on top of the start pump diaphragm 280. Holes 251 and 253 in the start pump body 252, holes 271 and 273 in the start pump gasket 270, holes 281 and 283 in the start pump diaphragm 280, and holes 291 and 293 in the start pump cover 290 are all aligned with the holes 221 and 223 in the carburetor body 210 to mount these components on the carburetor body 210.

The auxiliary pump body 250 as shown in FIGS. 7, 9, 104 and 11 includes a fuel intake passageway 252 bored into the fuel pump body 250 from its bottom surface 258. The fuel intake passageway 252 opens into an intake pathway 255 bored into the auxiliary pump body 250 from its side 259. A plug 257 seals one end of the intake pathway 255 adjacent to the side 259 of the pump body 250. The intake pathway 255 directs the fuel from the metering chamber to an inlet check valve 262 seated in an inlet valve chamber 261. The inlet check valve 262 is a simple viton disk that allows fuel to flow into a pumping chamber 260 bored into the auxiliary pump body 250 from its top surface 267, but prevents back flow. The inlet valve chamber 261 is bored into the auxiliary pump body 250 from the pump chamber 260. A calibrated inlet jet 263 may be positioned at the entrance of the inlet check valve 262 to meter the flow of fuel into the pumping chamber 260.

The auxiliary pump body 250 also includes a pulse passageway 254 bored through the auxiliary pump body 250 and a fuel discharge passageway 256 bored into the auxiliary pump body 250 from its bottom surface 258. The pulse passageway 254 is aligned with the pulse passageway 224 in the carburetor body 210 and the fuel discharge passageway 256 is aligned with the fuel discharge passageway 226 in the carburetor body 210. The fuel discharge passageway 256 opens to a discharge check valve chamber 265 bored into the auxiliary pump body 250 from the pumping chamber 260. A discharge check valve 266 is mounted in the valve chamber 265. The discharge check valve 266 is held close against its seat by a spring 268 positioned on the discharge side of the check valve 266. The spring force prevents fuel from being drawn out of the system by the carburetor manifold vacuum when the start pump 212 is shut off, i.e., when the throttle shaft 225 is rotated out of the start position and passageway 228 is no longer aligned with passageways 220 and 224. A calibrated jet 264 may be positioned on the inlet side of the discharge check valve 266. The calibrated jets 263 and 264 restrict the fuel flow into the engine to prevent an over-rich condition at startup.

The auxiliary pump gasket 270 maintains a seal between the auxiliary pump body 250 and the auxiliary pump diaphragm 280. The gasket 270 includes a pulse hole 274 aligned with the pulse passageway 224 in the carburetor body 210 and a hole 275 aligned with the pumping chamber 260 in the auxiliary pump body 250 to allow the auxiliary pump diaphragm 280 to communicate with the pumping chamber 260.

The auxiliary pump diaphragm 280 transfers the force of the crank case pulse to the fuel in the pumping chamber 260 of the auxiliary pump body 250. The flat auxiliary pump diaphragm 280 includes a pulse hole 284 aligned with the pulse passageway 224 in the carburetor body 210.

The pump cover 290, which seals the stack of gaskets 240 and 270, diaphragms 230 and 280, and the auxiliary pump body 252, accepts the crank case pulse P and directs it to the auxiliary pump diaphragm 280.

Referring back to FIGS. 7 and 8A-8B, a conventional butterfly throttle valve 203 is provided so that both ends of a valve shaft 225 protrude from the carburetor body 210. The throttle valve 203 comprises a round valve plate 205 attached to the valve shaft 225 rotatably retained in the body 210 and crossing the intake channel 214. Opening and closing of the throttle valve 2033 is conducted by a well-known conventional method, for example, by tension rotating a throttle valve lever arm 227 secured to one end of the valve shaft 225 by an acceleration operation, or by an elastic force of a return spring (see FIGS. 3 and 4) consisting of a helical coil spring installed at the same end of the shaft 225 and actuated by the throttle valve lever arm 227.

As depicted, a carburetor start system 201 is provided. The start system 201 comprises a primer pump bulb 206 operably coupled to a valve-opening mechanism 207. The primer pump bulb 206 is coupled to a first end of a starter shaft 204, which is slidably retained in the carburetor body 210. The starter shaft 204 traverses the air intake passage 214 and protrudes at both ends from opposite sides of the carburetor body 210. A start arm 202 having a cam surface is coupled to the starter shaft 204 on an opposite end of the shaft 204 from the primer bulb 206. The cam surface on the start arm 202 and a follower surface on a follower arm 229, which is secured to the throttle valve shaft 225 at an end opposite the throttle valve lever 227, translate the axially movement of the starter shaft 204 into rotation movement of the throttle shaft 225. As the primer pump bulb 206 is pressed to purge the carburetor of old fuel, the shaft 204 and start arm 202 move axially and the follower surface on the follower arm 229 coupled to the throttle shaft 225 follows the cam surface on the start arm 202 causing rotation of the throttle shaft 225 and valve plate 205 to a fast idle position that will make starting easier. Locking surfaces and on the follower arm 229 and the start arm 202, respectively, engage to lock the start arm 202 and follower arm 229 in place. The primer pump bulb 206 can be pushed or depressed several more times, preferably about five (5) to seven (7) times, to fill the carburetor with fuel. With the start arm 202 and follower arm 229 fixedly engaged, and the carburetor primed with fuel, the operator can pull a pull or crank rope or cord to start an engine to which the carburetor is coupled.

As the throttle lever arm 227 rotates in a run mode or during operation of the engine, the start arm 202 is released from engagement with the follower arm 229 and the shaft is caused to translate to its original or running position by an axial return spring (see FIGS. 1-4). The axial return spring is coiled about the starter shaft 204 between the primer bulb 206 and the carburetor body 210 and biases the primer pump bulb 206, starter shaft 204 and start arm 202 towards a running position wherein the start arm 202 is disengaged from and does not interfere with the rotation of the follower arm 229.

Figure 8A:
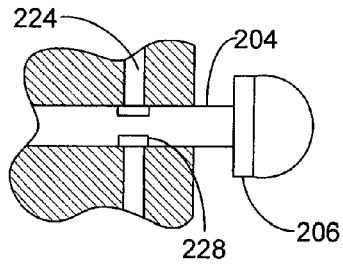
FIGS. 8A and 8B are partial cross-sectional views taken along line 8-8 in FIG. 7.
Figure 8B:
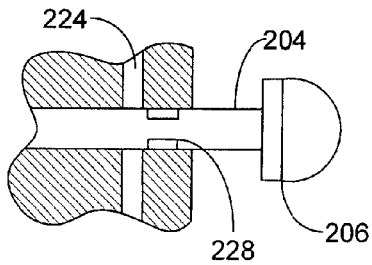
Figure 9:
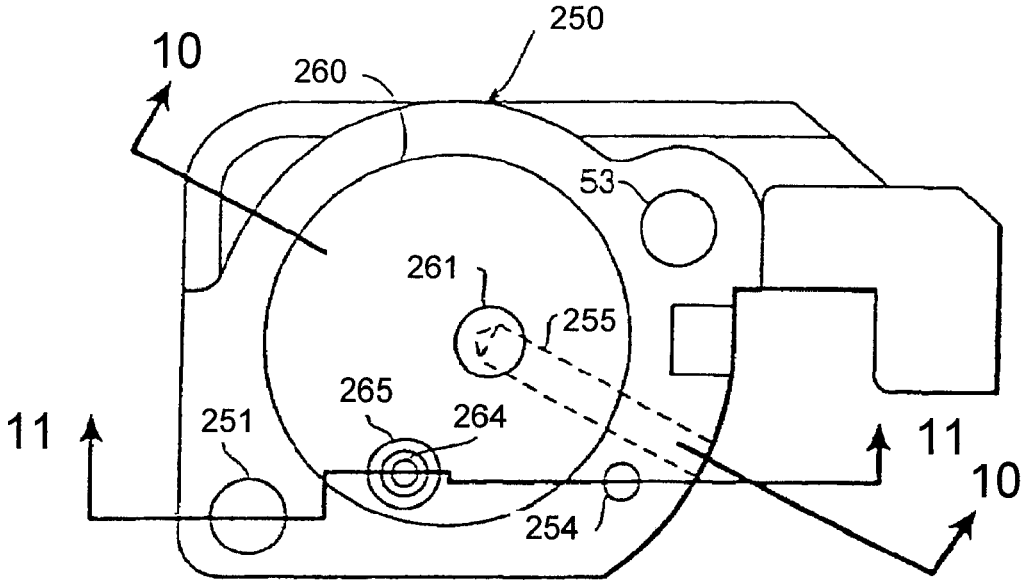
FIG. 9 is a top view of an auxiliary start pump body of the carburetor start pump circuit shown in FIG. 7.
Figure 10:
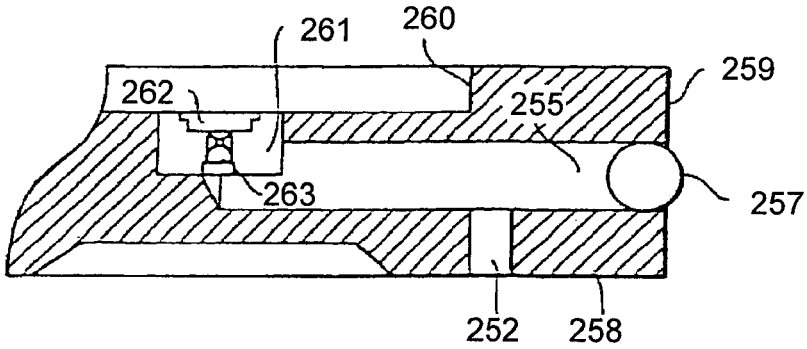
FIG. 10 is a partial cross-sectional view taken along line 10-10 in FIG. 9.
Figure 11:
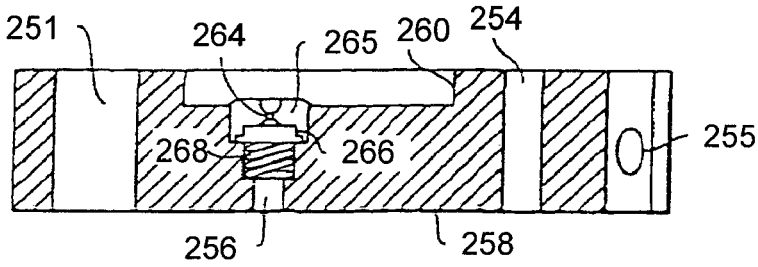
FIG. 11 is a cross-sectional view taken along line 11-11 in FIG. 9.
Figure 13:
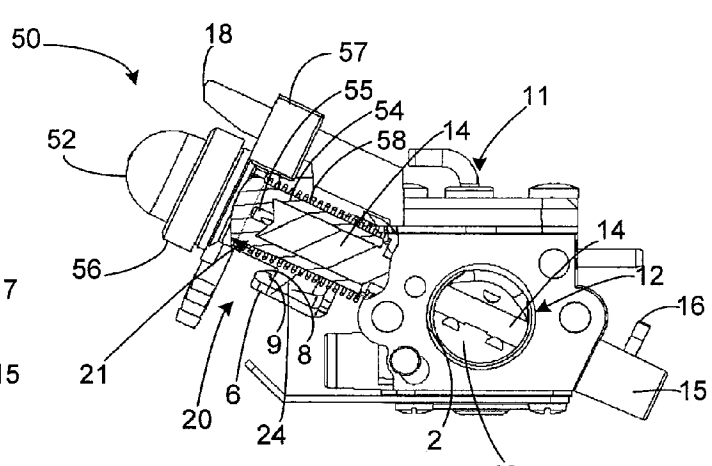
FIGS. 12 through 17 illustrate a butterfly or disc throttle valve carburetor embodiment with a choke and a start system that facilitates reliable starting.
Figure 12:
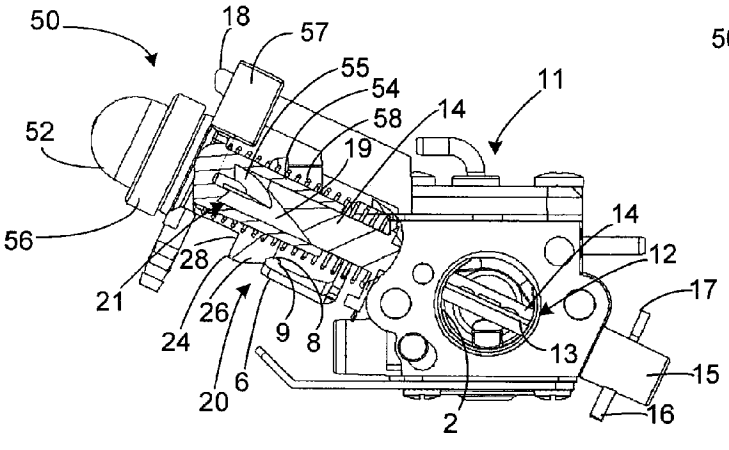
Figure 15:
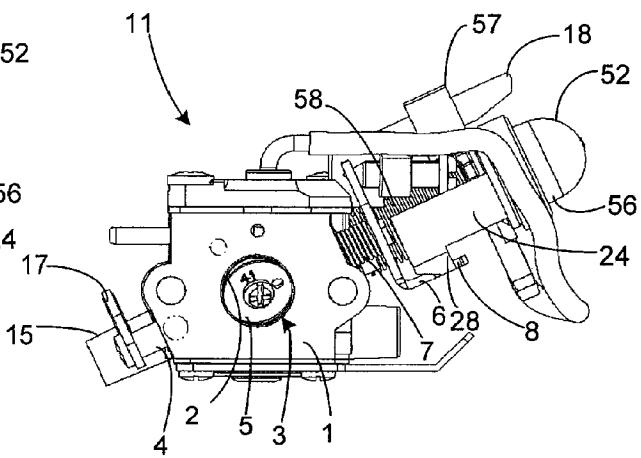
Figure 14:
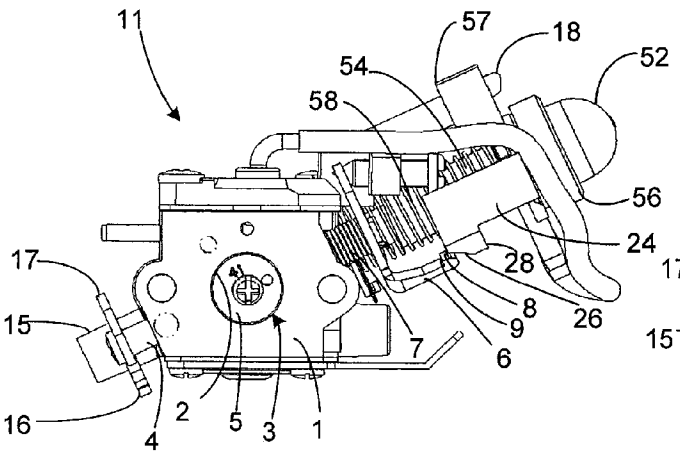
Figure 16:
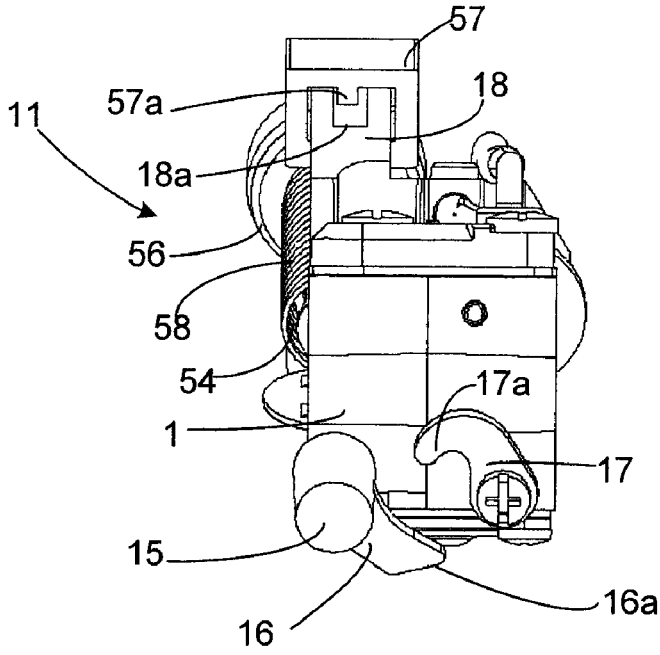
Figure 17:
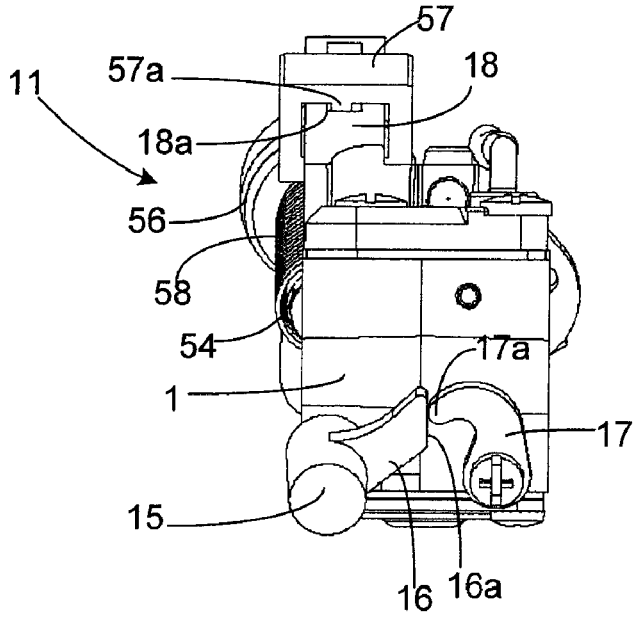
Figure 18:
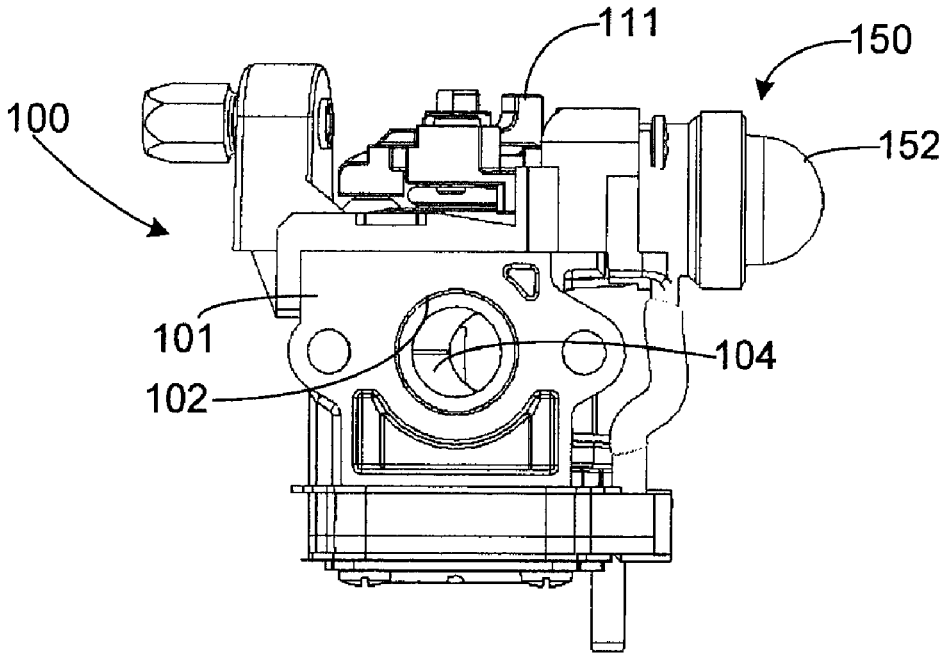
FIGS. 18 and 19 illustrate a rotary throttle valve carburetor embodiment with a start system that facilitates reliable starting.
Figure 19:
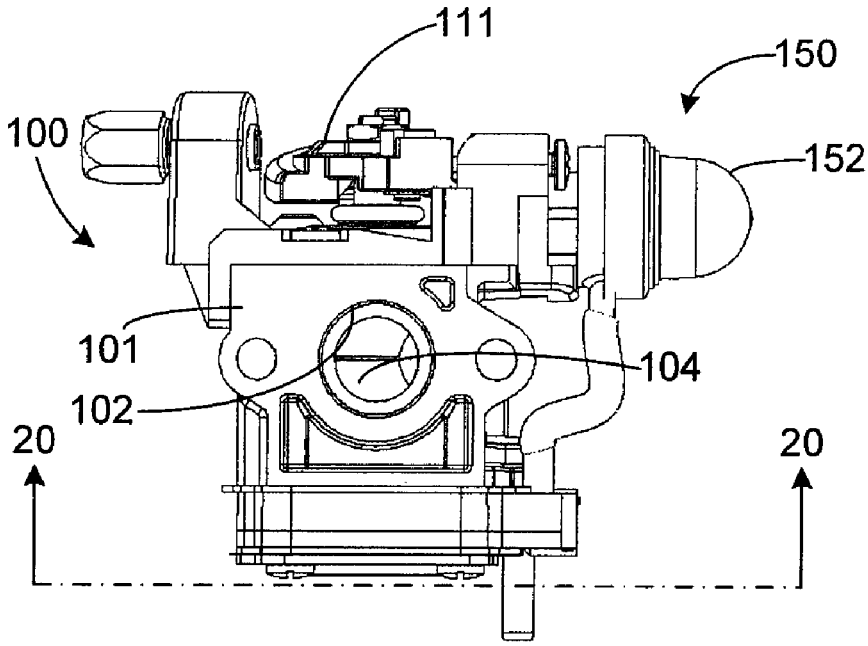
Figure 20:
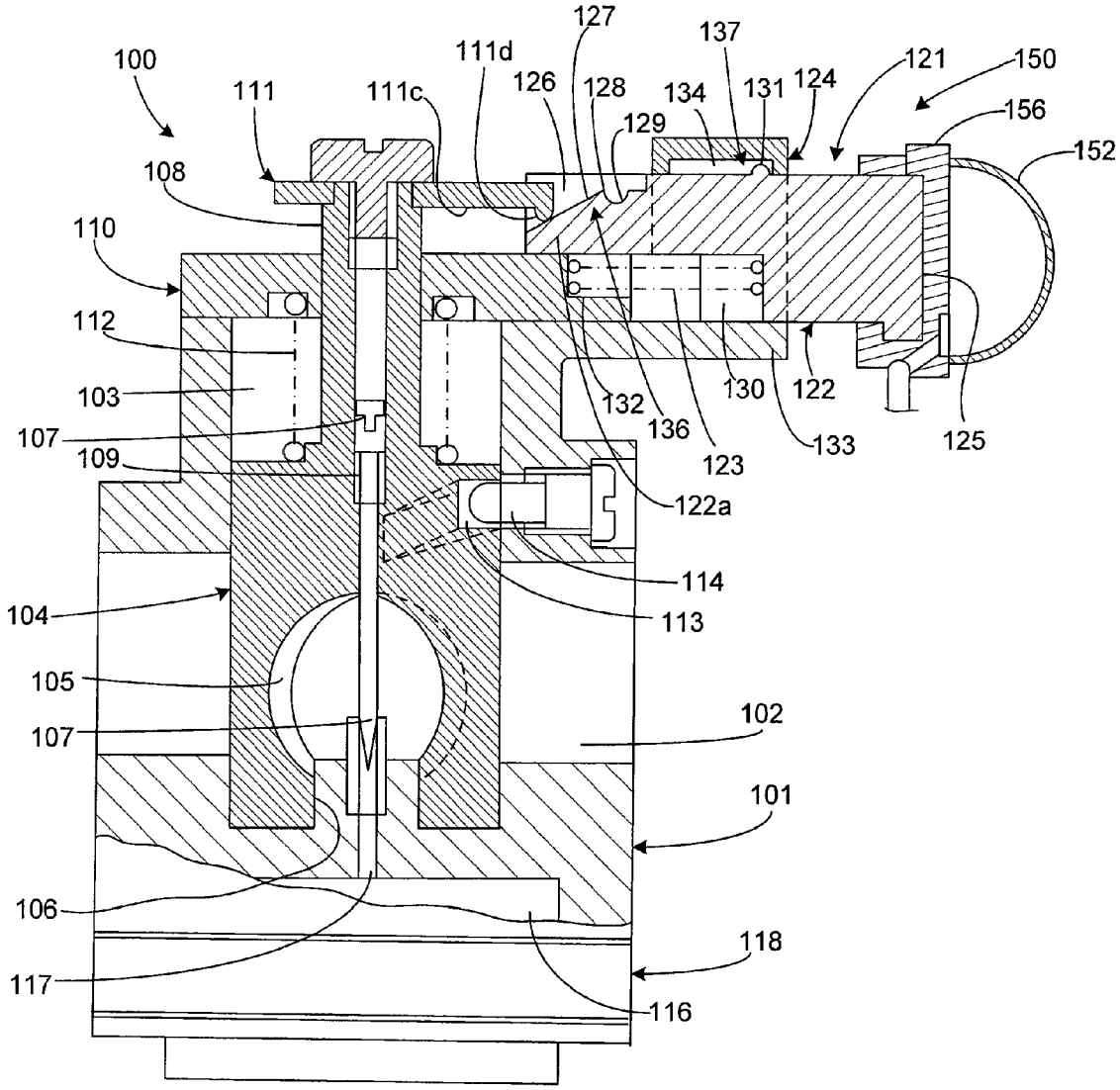
FIG. 20 is a longitudinal sectional view of the rotary throttle valve carburetor embodiment shown in FIGS. 18 and 19 taken along line 20-20 in FIG. 16.
Figure 21:
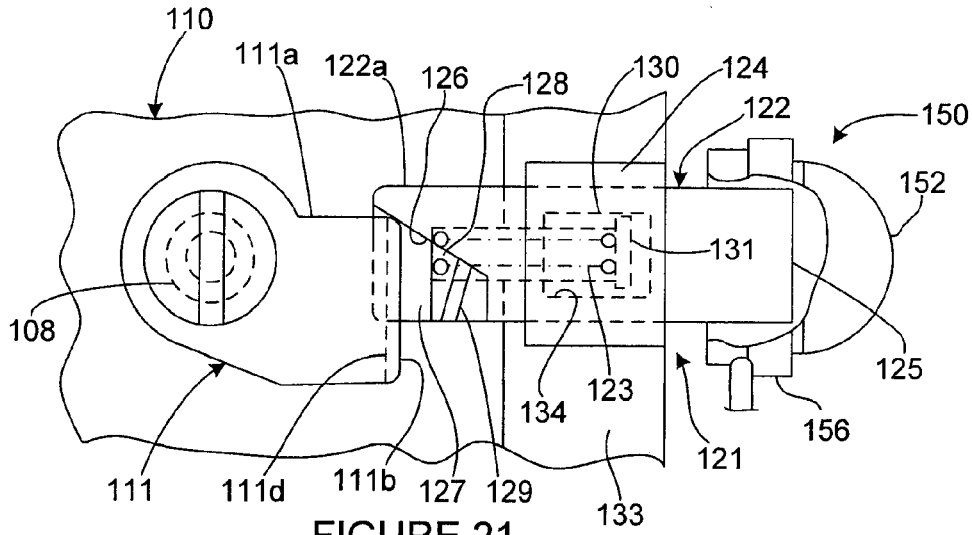
FIG. 21 is a partial plan view of the embodiment shown in FIG. 20.
Figure 22:
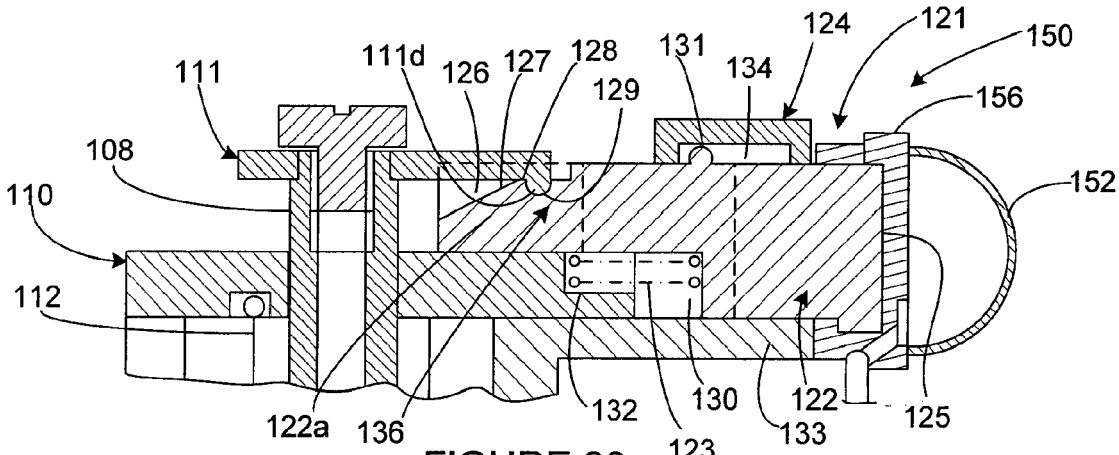
FIGS. 22 and 23 illustrate the placement of the cam part in the operative position.
Figure 23:
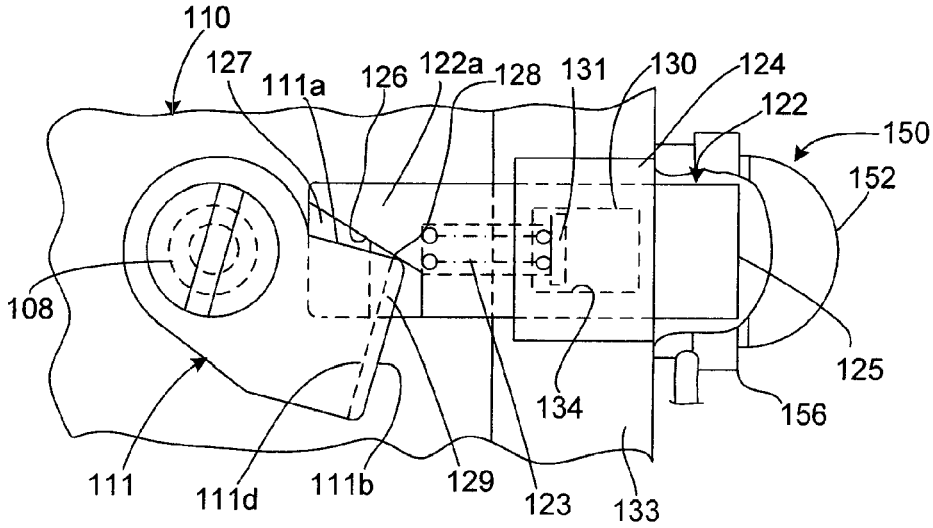

As shown in detail in FIGS. 8A and 8B, the pulse passageway 224 is shown to be operably interconnected to the starting pulse passageway 220 via a passageway or channel 228 cut into the starter shaft 204. Thus, passageways 220 and 224 are only in communication with one another when the starter shaft 204 and start arm 202 and, thus, the throttle valve plate 205 and throttle lever 227, are positioned in a start position which results in passageway 228 being aligned with passageway 224, as show in FIG. 8A.

In operation, the start pump 250 is activated by turning on the crank case pulse supplied to it. As noted, the crank case pulse P is controlled with the starter shaft 204 as shown in FIGS. 8A and 8B, or similarly by a choke shaft or the like. In the preferred embodiment, the passageway 228 in the starter shaft 204 aligns when in a start position with passageway 224 in the carburetor body 210 and the pulse P is allowed to enter the start pump 212 when the primer bulb 206 is depressed causing the starter shaft 204 and start arm 202 to move axially and lock the start arm 202 and follower arm 229 in a start position. This control configuration ensures that the start pump 212 only feeds fuel to the engine during start-up.

The pulse P travels up through the stack of the main fuel pump diaphragm 230 and the main fuel pump gasket 240, and then through the auxiliary pump body 252, diaphragm 280, and gasket 270 and on into the start pump cover 290. The pulse P moves the diaphragm 280 up and down which creates a corresponding vacuum and pressure in the pumping chamber 260 of the auxiliary pump body 250. The vacuum pulse opens the inlet check valve 262 and draws fuel I from the metering chamber (not shown) of the carburetor body 210. By drawing fuel from the metering chamber, the carburetor start pump circuit advantageously acts as an air purge or primer.

The fuel I passes through the carburetor body 210 through the main fuel pump diaphragm 230 and gasket 240, into the start pump body 250 and on into the pumping chamber 260 through the inlet check valve 262 and, optionally, through the calibrated metering jet 263. When the auxiliary pump diaphragm 280 is pushed down into the auxiliary pump body 250 by the crank case pulse P, the inlet check valve 262 is forced closed and the force of the crank case pulse P is transferred to the fuel forcing the fuel through the discharge check valve 266 and, optionally, first through the calibrated metering jet 264. The fuel must pass through the starting jet 264 and press open the spring 268 loaded check valve 266 to leave the pumping chamber 260. The spring 268 exerts a sufficient force on the check valve 266 to prevent it from being opened by a manifold vacuum and thus ensuring that fuel is not drawn through the carburetor start pump circuit unless the start pump 212 is receiving a pulse P.

The fuel D then exits the auxiliary pump body 250 through the discharge fuel passageway 256 and passes back through the main pump gasket 240 and diaphragm 230, and on through the fuel discharge passageway 226 into the throttle bore 214 in the carburetor body 210. When the engine is warmed up, the operator shuts off the start pump circuit and the engine begins normal operation.

As mentioned above, often times the operator may neglect to shut off the start pump circuit when the engine is warmed up or accidentally engage the start pump when the engine is already operating and warmed up. This may result in the engine stalling or "conking out" from too much fuel being discharged into the throttling bore 214. One approach to prevent the engine from stalling is to place a calibrated restriction or jet 285 anywhere along the path that the start pulse P travels, and preferably somewhere between the carburetor body 210 and the start pump cover 290 of the auxiliary fuel pump 212. The jet 285 is placed in the pulse hole 284 of the start pump diaphragm 280.

The jet 285 is positioned and calibrated such that the jet 285 tends to substantially choke off high frequency pulses P transmitted from the engine, thus substantially choking off the power to move the start pump diaphragm 280 at the high frequencies. In other words, when the engine starts to warm up, the jet 825 tends to substantially reduce the amount of fuel D that the auxiliary fuel pump 212 discharges into the throttling bore 214.

When the engine is being cranked, a low frequency pulse P, e.g., about 18 hz or about 800 rpm, is transmitted from the engine. At the lower frequency, a substantial portion of the pulse P will pass through the jet 285 sufficient to operate the start pump diaphragm 280. When the engine starts to warm up, it starts to supply a higher frequency pulse P, e.g., about 80 hz or about 5000 rpm. At this point, the engine will no longer need mixture enrichment. The jet 285 tends to choke off a substantial amount of the pulse P transmission to the start pump circuit sufficient to substantially decrease the operation of the start pump diaphragm 280. Thus, the start pump circuit will advantageously cease operation or at least substantially limit the amount of fuel D discharged into the throttling bore 214, preventing the engine from conking out or stalling.

Referring to FIGS. 12 through 17, another embodiment of a carburetor start system is illustrated. As depicted, as with the previous embodiment described above, the carburetor 11 includes a main body 1 with an air intake passage 2 passing longitudinally through the carburetor main body 1. A conventional butterfly throttle valve 3 is provided so that both ends of a valve shaft 4 protrude from the body 1. The throttle valve 3 comprises a round valve plate 5 attached to the valve shaft 4 rotatably retained in the body 1 and crossing the intake channel 2. Opening and closing of the throttle valve 3 is conducted, for example, by tension rotating a throttle valve lever arm 6 secured to one end of the valve shaft 4 by an acceleration operation, or by an elastic force of a return spring 7 consisting of a helical coil spring installed at same end of the shaft 4 and actuated by the throttle valve lever arm 6.

In addition to the above, a choke valve 12 is provided so that both ends of a valve shaft 14 protrude from the body 1. The choke valve 12 comprises a valve plate 13 attached to the valve shaft 14 rotatably retained in the body 1 and crossing the intake channel 2. A choke lever 15 is attached to a first end the valve shaft 14 on the throttle lever arm 6 side of the carburetor body 1. The choke lever 15 includes a lever arm 16 with a locking surface 16*a* that when rotated a predetermined amount abuts an end 17*a* of a locking arm 17 coupled to an end of the throttle valve shaft 4 opposite the throttle lever arm 6 to fix choke valve 12 in a starting position.

A carburetor start system 50 comprises a primer pump bulb 52 operably coupled to a choke valve-opening mechanism 21 and, optionally, also to a throttle valve-opening mechanism 20. The primer pump bulb 52 includes a base body 56 coupled to a cylindrical sleeve 54 slidably received over an end of the choke valve shaft 14 opposite the choke lever arm 15. The primer pump bulb 52 further comprises a retainer arm 57 coupled to the base body 56 and slidably received over a guide arm 18 extending from the carburetor body 1 to maintain the orientation of the primer bulb 52 relative to the choke valve shaft 14. The retainer arm 57 and guide arm 18 preferably include a key or protrusion 57*a* extending from the retainer arm 57 and received in a groove or keyway 18*a* formed in the guide arm 18.

The choke valve opening mechanism preferably includes a cam surface 19 cut into the valve shaft 14 and a follower 55 extending from the base 56 into the interior of the sleeve 54 that engages the cam surface 19 to translate the axially movement of the sleeve 54 into rotational movement of the choke shaft 14. As the primer pump bulb 52 is pressed to purge old fuel from the carburetor, the sleeve 54 moves axially toward the choke lever arm 15 with the follower 55 engaging the cam surface 19 causing the choke valve shaft 14 and valve plate 13 to rotate to a closed or starting position. By rotating the shaft 14 and valve plate 13 to a starting position, the locking surface 16*a* of the choke lever arm 16 abuts the end 17*a* of the locking arm 17 fixing the choke valve 12 in the starting position. The primer pump bulb 52 can be pushed or depressed several more times, preferably about five (5) to seven (7) times, to fill the carburetor 11 with fuel. With the choke lever arm 16 and locking arm 17 fixedly engaged, and the carburetor 11 primed with fuel, the operator can pull a pull or crank rope or cord to start an engine to which the carburetor is coupled.

As the throttle shaft 4 rotates in a run mode or during operation of the engine, the choke lever arm 16 is released from engagement with the locking arm 17 and the choke valve shaft 14 is caused to rotate by the bias of an axial return spring 58 applied to the sleeve 54 to its original or running position with the choke valve plate 13 in an open position. The axial return spring 58 is coiled about the sleeve 54 between the base body 56 and the carburetor body 1 and biases the primer pump bulb 52 and sleeve 54 in a direction away from the carburetor body 1 and towards a running position wherein the choke lever arm 16 is unengaged from and does not interfere with the movement of the locking arm 17 on the throttle shaft 4.

As noted above, the carburetor start system 50 optionally includes a throttle valve opening mechanism 21 that comprises a start arm 24 having a cam surface 26 extending from the base body 56 of the primer pump bulb 52. As the primer pump bulb 52 is pressed purge old fuel from the carburetor 11, the start arm 24 moves axially and a follower surface 8 on the throttle lever arm 6 coupled to the throttle shaft 4 follows the cam surface 26 on the start arm 24 causing rotation of the throttle shaft 4 and valve plate 5 to a fast idle position—i.e., preferably rotated about 20 to 30 degrees. Locking surfaces 9 and 28 on the throttle lever arm 6 and the start arm 24 engage to lock the start arm 24 and throttle lever arm 6 in place. The primer pump bulb 52 can be pushed or depressed several more times, preferably about five (5) to seven (7) times, to fill the carburetor 11 with fuel. With the start arm 24 and throttle level arm 6 fixedly engaged, and the carburetor 11 primed with fuel, the operator can pull a pull or crank rope or cord to start an engine to which the carburetor is coupled. As the throttle lever arm 6 rotates in a run mode or during operation of the engine, the start arm 24 is released from engagement with the throttle lever arm 6.

Referring FIGS. 18 through 25, another embodiment of a carburetor start system is illustrated. As depicted, a carburetor 100 includes a main body 101 with an air intake passage 102 passing longitudinally through the carburetor main body 101, and a valve hole 103 which is perpendicular to the air intake passage 102, and which is closed at one end. A cylindrical throttle valve 104 is inserted into the valve hole 103 so that said throttle valve 104 can rotate, and so that said throttle valve 104 can move in the central axial direction.

The throttle valve 104 has a throttle orifice 105 which is perpendicular to the central axial line of the throttle valve 104 and which has approximately the same diameter as the air intake passage 102. The throttle valve 104 also has a nozzle insertion orifice 106, a metering needle 107 and a valve shaft 108 which are installed on the central axial line of the throttle valve 104. The nozzle insertion orifice 106 is formed in the end portion located at the closed end of the valve hole 103. The valve shaft 108 is an integral part of the throttle valve 104. The valve shaft 108 extends from the end portion of the throttle valve 104 located at the open end of the valve hole 103, and passes through the cover body 110 of the valve hole 103 so that said valve shaft 108 protrudes to the outside of the carburetor main body 101. The metering needle 107 is fastened in the throttle valve 104 in such a manner that the distance by which said metering needle 107 protrudes into the throttle orifice 105 can be adjusted by screwing a screw head part 107*a* at the base end of the metering needle 107 into a screw hole 109.

A lever 111, which is turned by the operation of the throttle by an operator, is fastened to the shaft end of the valve shaft 108. A push spring 112 consisting of a compression coil spring is mounted between the cover body 110 and the throttle valve 104 so that said push spring 112 surrounds the valve shaft 108. A groove cam 113 is formed in the outer circumferential surface of the throttle valve 104 so that the groove cam 113 extends around roughly one-fourth of the circumference of the throttle valve 104. A supporting pin 114 which is screwed into the carburetor main body 101 is inserted and engaged in the groove cam 113.

Figure 24:
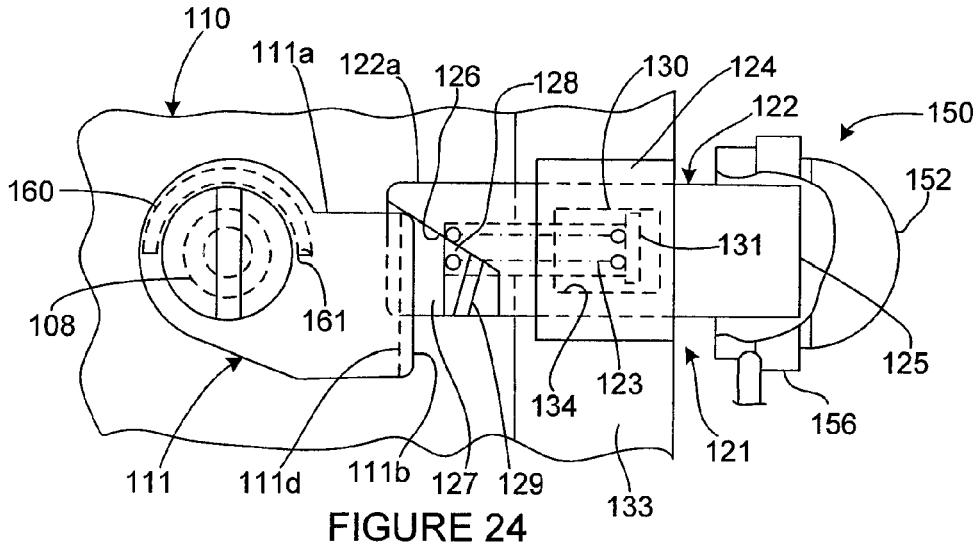
FIGS. 24 and 25 illustrate alternative embodiments depicting a cam ramp on the under-side of the throttle lever.
Figure 25:
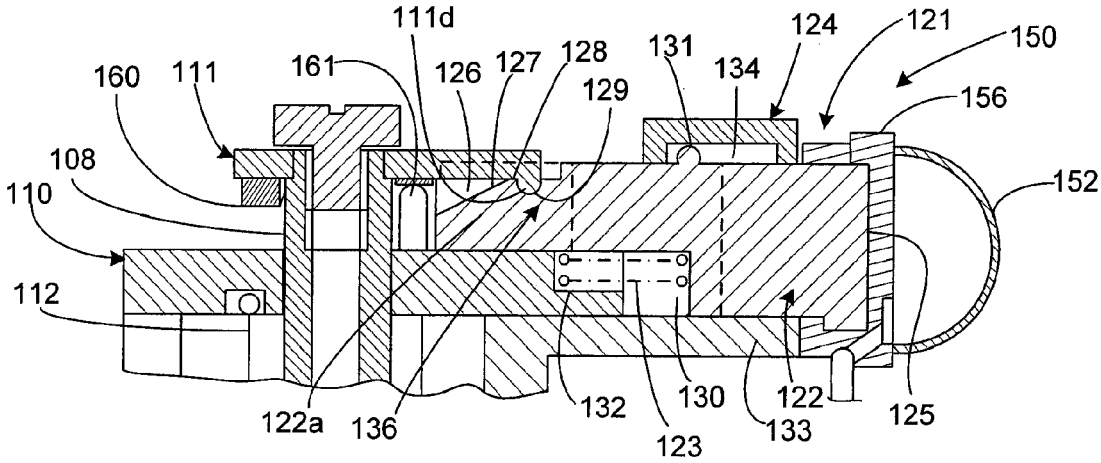

Alternatively, as shown in FIGS. 24 and 25, a cam ramp 160 is formed on an underside of the lever 111. A follower pin 161 extends from cover body 110 and engages the ramp cam 160.

When the lever 111 is turned by the operation of the accelerator, the throttle valve 104 rotates as a unit with the lever 111, thus causing the degree of overlap between the throttle orifice 105 and the air intake passage 102 to vary so that the intake air flow rate of the engine is controlled. At the same time, the throttle valve 104 moves along the central axial line in accordance with the groove cam 113 or cam ramp 160, thus causing the depth of insertion of the metering needle 107 into the fuel nozzle 115 to vary so that the fuel flow rate is controlled. This operation is the same as that of a conventional rotary throttle valve type carburetor.

A constant-fuel chamber 116 which is the same as that of a well-known diaphragm type carburetor is formed in the opposite end surface of the carburetor main body 101 from the cover body 110. The fuel chamber 116 is separated from the atmosphere by a diaphragm. The fuel in the constant-fuel chamber 116 passes through a fuel passage 117, and is blown into the throttle orifice 105 from the fuel nozzle 115 and thus supplied to the engine.

A fuel pump 118 is installed on the outside of the constant-fuel chamber 116. This fuel pump 118 is a well-known pump in which the diaphragm is operated by the pulse pressure generated in the crankcase of the engine, so that fuel in the fuel tank is supplied to the constant-fuel chamber 116.

A carburetor start system 150 comprises valve-opening mechanism 121 installed on the cover body 110 and operably coupled to a primer pump bulb 152. The valve-opening mechanism 121 is equipped with a substantially square cam part 122 which performs a linear reciprocating movement along the outside surface of the cover body 110, and a return spring 123 which places the cam part 122 in an inoperative position. The cam part 122 is passed through a gate-formed guide part 124 which protrudes from the outside surface of the cover body 110.

The base end surface of the cam part 122 is formed as a flat pushing surface 125. A base 156 of the primer pump bulb 152 is coupled to the cam part 122 and abuts the pushing surface 125. A first cam surface 126 formed on the tip end portion 122*a* of the cam part 122 contacts the side surface 111*a* of the lever 111 and pushes the lever 111 in the direction that increases the air flow rate. A second cam surface 127, also formed on the tip end portion 122*a* of the cam part 122, contacts the tip edge 111*b* of the lever 111 and pushes the lever 111 so that the lever 111 is caused to move in the axial direction that increases the fuel flow rate. A holding surface 128 which overlaps with the tip end portion 111*c* of the inside surface of the lever 111 is also formed on the tip end portion 122*a* of the cam part 122. An engaging groove 129 is formed in the holding surface 128. The portion of the tip edge 111*b* of the lever 111 which contacts the second cam surface 127 forms an engaging pawl or detent 111*d* that is inserted into the engaging groove or detent pocket groove 129.

A groove hole 130 in which a portion of the return spring 123 is mounted, and a projection 131 which is used for stroke regulation, are formed in the base end portion of the cam part 122. A cut-out groove 132 in which a portion of the return spring 123 is mounted is formed in one edge of the cover body 110. The above-mentioned guide part 124 is disposed on a receiving edge 133 which protrudes outwardly from the carburetor main body 101. A regulating groove 134 used for stroke regulation is formed in the inside surface of the guide part 124.

The aforementioned cam part 122 is passed through the guide part 124 so that the tip end portion 122*a* of the cam part 122 overlaps with the cover body 110, and so that the base end portion of the cam part 122 overlaps with the receiving edge 133. The stroke of the cam part 122 in the longitudinal direction is regulated by a projection 131 which is inserted into the regulating groove 134. The cam part 122 is held in the inoperative position (in which the cam part 122 is withdrawn in a direction toward its base end) by the above-mentioned return spring 123 (consisting of a compression coil spring) which is mounted in the cut-out groove 132.

While in the idle position, the side surface 111*a* and tip edge 111*b* of the lever 111, respectively, contact the first cam surface 126 and second cam surface 127, respectively, or are slightly separated from said cam surfaces 126 and 127, respectively.

In order to start the engine, the operator's fingertips are pressed against the primer pump bulb 152 causing old fuel to be purged and new fuel to enter the carburetor 100 through a primer tube 154. Since the primer pump bulb base abuts the pushing surface 125, as the operator's fingertips are pressed against the primer pump bulb 152, the cam part 122 is caused to advance wherein the first cam surface 126 pushes the side surface 111*a* so that the lever 111 is caused to turn in the direction that increases the air flow rate. At the same time, the second cam surface 127 pushes the tip edge 111*b* so that the lever is caused to move in the direction that increases the fuel flow rate. However, the lever 111 stops when the engaging pawl 111*d* engages in the engaging groove 129.

The second cam surface 127 is formed with an angle of inclination which is equal to or greater than that of the groove cam 113 or cam ramp 160. As a result of the aforementioned movement of the lever 111, the degree of overlap between the air intake passage 102 and the throttle orifice 105 of the throttle valve 104 is slightly increased, and the depth of insertion of the metering needle 107 into the fuel nozzle 115 is slightly reduced, so that the amounts of air and fuel necessary for starting are supplied to the engine. The angle of inclination of the second cam surface 127 is preferably set at a larger value than the angle of inclination of the groove cam 113 or cam ramp 160, so that the increase in the fuel flow rate is greater than the increase in the air flow rate.

The tip end portion 111*c* of the inside surface of the lever 111 is pressed against the holding surface 128 by the spring force of the push spring 112, so that even if the fingers are removed, the cam part 122 is fixed in the operative position by the frictional force generated between the above-mentioned parts, and is not returned by the spring force of the return spring 123.

The lever 111 is mechanically coupled with the cam part 122 by an anchoring means 136 comprising of the engaging pawl 111*d* and engaging groove 129. Accordingly, the lever 111 is stably fixed in the operative position so that starting of an engine of a lawn and garden machine can be performed by pulling a start or crank cord or rope.

When warm-up of the engine is completed, and a transition to normal operation is to be made, the lever 111 is caused to turn in the direction of increase of fuel and air by ordinary operation of the throttle. As a result, the engaging pawl 111*d* is released from the engaging groove 129 at more or less the same time. Furthermore, the tip end portion 111*c* of the inside surface is separated from the holding surface 128 so that the cam part 122 is returned to the inoperative position by the spring force of the return spring 123. Afterward, the lever 111 can be turned from the idle position to the full-open position by operation of the accelerator, without being constrained by the cam part 122.

The cam part 122 returns to the inoperative position (where the return spring 123 recovers its extended length), and remains in this position. In the working configuration shown in the figures, the stroke regulating means 137, comprising the projection 131 and regulating groove 134, prevents the cam part 122 from advancing to an excessive degree wherein the lever 111 is turned more than is necessary. In addition, this stroke regulating means 137 eliminates any concern that the cam part will be withdrawn beyond the inoperative position wherein the cam part 122 would fall out of the cover body 110 and carburetor main body 101. Moreover, in cases where no anchoring means 136 is provided, this stroke regulating means 137 enables the cam part 122 to move to a fixed operative position so that stable starting can be accomplished.

Instead of inserting the cam part 122 into a gate-formed guide part 124, it would also be possible to cause movement between the inoperative position and the operative position using a dovetail groove or other well known sliding guide means. Furthermore, instead of using a compression coil spring, it would also be possible to use a hollow or solid block consisting of a highly elastic material, e.g., rubber, as the return spring 123.

As was described above, the present invention is devised so that a lever which transmits the operation of the accelerator to the throttle valve is turned slightly from the idle position by a cam part which causes the throttle valve to be held in a state that increases the amounts of air and fuel supplied to the engine. Accordingly, starting of the engine at low temperatures can be reliably accomplished by means of an extremely simple operation. Furthermore, the transition to normal operation by means of the accelerator can be smoothly accomplished.

Moreover, in cases where an anchoring means for the lever and cam part and a stroke regulating means for the cam part are provided, starting can be accomplished even more reliably.

While the above description contains many specifics, these should not be construed as limitations on the scope of the invention, but rather as examples of particular embodiments thereof. Many other variations are possible. Accordingly, the scope of the present invention should be determined not by the embodiments described herein, but by the appended claims and their legal equivalents.

What is claimed:

1. A carburetor comprising a body with an air intake passageway bored there through, a throttle valve positioned within the intake passageway and operable to adjust the opening of the intake passageway, a valve opening mechanism operably coupled to the throttle valve, and a primer pump bulb in fluid communication with a fuel metering chamber and the air intake passageway and coupled to the valve opening, wherein depressing the primer pump bulb causes the throttle valve to rotate to a start position.

2. The carburetor of claim 1 wherein the throttle valve is a butterfly throttle valve.

3. The carburetor of claim 2 wherein the throttle valve comprising a throttle shaft rotatably received in the body and traversing the air intake passageway, the throttle shaft having first and second ends extending from the body, a valve plate coupled to the throttle shaft and positioned within the intake passage, and a lever coupled to the first end of the throttle shaft.

4. The carburetor of claim 3 wherein the valve opening mechanism comprising a starter shaft slidably received in the body and traversing the air intake passageway, the start shaft having first and second ends extending from the body, wherein the primer bulb is coupled to the first end of the start shaft, and a start arm coupled to the second end of the starter shaft and operably couplable to a follower arm coupled to the second of the throttle shaft, wherein the valve opening mechanism translates an axial force applied to the primer bulb into rotational motion of the throttle valve.

5. The carburetor of claim 4 wherein the start arm includes a cam surface and the follower arm includes a follower surface, wherein the throttle shaft is caused to rotate as the cam surface of the start arm engages the follower surface of the follower arm as the starter shaft moves axially.

6. The carburetor of claim 5 wherein the start arm and follower arms include first and second locking surfaces operably couplable to releasably fix the start arm and follower arm in a start position.

7. The carburetor of claim 1 wherein the throttle valve is a rotary throttle valve.

8. The carburetor of claim 7 wherein the throttle valve comprising a throttle shaft having a first end extending from the body, a cylindrical valve coupled to a second end of the throttle shaft and positioned within the intake passage, wherein the cylindrical valve includes a throttle orifice extending through the cylindrical valve, and a lever coupled to the first end of the throttle shaft.

9. The carburetor of claim 8 wherein the valve opening mechanism comprising a cam member having first and second ends, the cam member having one or more cam surfaces formed at the first end and operably couplable to the lever, wherein the primer bulb is coupled to the first end of the cam member, and wherein the valve opening mechanism translates an axial force applied to the primer bulb into rotational motion of the throttle valve.

10. The carburetor of claim 9 wherein the one or more cam surfaces of the cam member includes a first cam surface operably couplable to the lever to cause the throttle shaft to rotate as the cam member is caused to move axially and a second cam surface operably couplable to the lever to cause the throttle lever and cylindrical valve to lift as the cam member is caused to move axially.

11. The carburetor of claim 10 wherein the lever includes a pawl and the cam member includes a groove operably couplable to releasably fix the cam member and lever in a start position.

12. A carburetor comprising a body with an air intake passageway bored there through, and a start mechanism operably couplable to one or more of a throttle valve and a choke valve, the start mechanism including a primer pump bulb in fluid communication with a fuel metering chamber and the air intake passageway, the start mechanism being configured to translate an axial force applied to the primer pump bulb to rotational movement of one or more of the choke valve and the throttle valve to rotate one or more of the choke valve and the throttle valve to a start position.

13. The carburetor of claim 12 wherein the start mechanism includes a valve opening mechanism operably coupled to one or more of the choke valve and the throttle valve.

14. The carburetor of claim 13 wherein the choke valve comprises a choke valve shaft rotatably received in the body and traversing the air intake passageway, the choke valve shaft having first and second ends extending from the body, and a choke valve plate coupled to the choke valve shaft and positioned within the intake passage.

15. The carburetor of claim 14 wherein the valve opening mechanism comprising a starter sleeve slidably received over the choke valve shaft adjacent the first end, wherein the primer bulb is coupled to an end of the starter sleeve, wherein the valve opening mechanism translates an axial force applied to the primer bulb into rotational motion of the throttle valve.

16. The carburetor of claim 15 wherein the choke valve shaft includes a cam surface and the starter sleeve includes follower arm includes a follower member operably couplable with the cam surface, wherein the choke valve shaft is caused to rotate as the follower member of the starter sleeve engages the cam surface of the choke valve shaft as the starter sleeve is caused to move axially by an axial force applied to the primer pump bulb.

17. The carburetor of claim 16 wherein the throttle valve comprises a throttle shaft rotatably received in the body and traversing the air intake passageway, the throttle shaft having first and second ends extending from the body, a valve plate coupled to the throttle shaft and positioned within the intake passage, and a throttle lever arm coupled to the first end of the throttle shaft.

18. The carburetor of claim 17 wherein the valve opening mechanism further comprises a choke lever arm coupled to the second end of the choke valve shaft and a locking arm coupled to the second end of the throttle shaft, the choke lever arm operably couplable to the locking arm to releasably fix the choke lever arm in a start position.

19. The carburetor of claim 18 wherein the valve opening mechanism further a start arm extending from a base of the primer pump bulb, wherein the start arm is operably couplable to the throttle lever arm to translate an axial force applied to the primer bulb into rotational motion of the throttle valve to rotate the throttle valve to a start position.

20. The carburetor of claim 19 wherein the start arm includes a cam surface and the throttle lever arm includes a follower surface, wherein the throttle shaft is caused to rotate as the cam surface of the start arm engages the follower surface of the throttle lever arm as the starter sleeve moves axially.

* * * * *